US009039578B2

(12) United States Patent
Dalebout

(10) Patent No.: US 9,039,578 B2
(45) Date of Patent: May 26, 2015

(54) EXERCISE DEVICE WITH LATCHING MECHANISM

(71) Applicant: ICON Health & Fitness, Inc., Logan, UT (US)

(72) Inventor: William T Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 287 days.

(21) Appl. No.: 13/693,279

(22) Filed: Dec. 4, 2012

(65) Prior Publication Data

US 2013/0143721 A1 Jun. 6, 2013

Related U.S. Application Data

(60) Provisional application No. 61/567,252, filed on Dec. 6, 2011.

(51) Int. Cl.

| | |
|---|---|
| ***A63B 22/02*** | (2006.01) |
| ***A63B 22/00*** | (2006.01) |
| *A63B 71/00* | (2006.01) |

(52) U.S. Cl.

CPC ..... *A63B 22/0002* (2013.01); *A63B 22/02* (2013.01); *A63B 2071/0072* (2013.01); *A63B 2210/50* (2013.01)

(58) Field of Classification Search

CPC ..... A63B 22/0046; A63B 22/02; A63B 2022/0033; A63B 2210/50

USPC ..... 482/51–54, 57, 142, 908; 119/700

See application file for complete search history.

(56) References Cited

U.S. PATENT DOCUMENTS

| | | | | |
|---|---|---|---|---|
| 931,394 | A | 8/1909 | Day | |
| 5,662,557 | A | 9/1997 | Watterson et al. | |
| 5,672,140 | A | 9/1997 | Watterson et al. | |
| 5,674,156 | A | 10/1997 | Watterson et al. | |
| 5,674,453 | A | 10/1997 | Watterson et al. | |
| 5,772,560 | A | 6/1998 | Watterson et al. | |
| 5,868,648 | A * | 2/1999 | Coody et al. | 482/54 |
| 6,723,027 | B1 * | 4/2004 | Lo | 482/54 |
| 6,758,791 | B1 * | 7/2004 | Kuo | 482/54 |
| 6,811,518 | B2 * | 11/2004 | Lin | 482/54 |
| 6,830,540 | B2 * | 12/2004 | Watterson et al. | 482/54 |
| 6,974,404 | B1 | 12/2005 | Watterson et al. | |
| 7,540,828 | B2 | 6/2009 | Watterson et al. | |
| 7,736,279 | B2 | 6/2010 | Dalebout et al. | |
| 7,740,563 | B2 | 6/2010 | Dalebout et al. | |
| 7,766,797 | B2 | 8/2010 | Dalebout et al. | |
| 7,775,940 | B2 | 8/2010 | Dalebout et al. | |
| 7,909,740 | B2 | 3/2011 | Dalebout et al. | |
| 2009/0181831 | A1 * | 7/2009 | Kuo | 482/54 |
| 2010/0056344 | A1 * | 3/2010 | Chu | 482/54 |

* cited by examiner

*Primary Examiner* — Stephen Crow
*Assistant Examiner* — Gregory Winter
(74) *Attorney, Agent, or Firm* — Holland & Hart LLP

(57) ABSTRACT

An exercise device includes a first frame, a second frame that is pivotally connected to the first frame and movable relative to the first frame between a storage position and an operating position, and a latching mechanism that selectively holds the second frame in the storage position. The latching mechanism includes a seat having a seat engagement surface, a seat engagement member selectively positioned on the seat engagement surface to hold the second frame in the storage position, and a lever that selectively rotates the seat engagement member off of the seat to allow the second frame to move from the storage position to the operating position.

17 Claims, 4 Drawing Sheets

EXERCISE DEVICE WITH LATCHING MECHANISM

RELATED APPLICATIONS

This application claims the benefit of U.S. Provisional Patent Application No. 61/567,252 filed on Dec. 6, 2011.

TECHNICAL FIELD

This disclosure relates generally to systems, methods, and devices for exercise. More particularly, the disclosure relates to an exercise device latching mechanism that selectively maintains a portion of an exercise device in a storage position.

BACKGROUND

Exercise devices, such as treadmills, have become very popular for use in improving health and fitness. Many such exercise devices are made for home use, thereby allowing users to exercise in the comfort and privacy of their own homes. In an effort to reduce the amount of space exercise devices occupy when not in use, many exercise devices are made to fold up. For instance, treadmills commonly have a treadbase that may be moved between an operating position in which a user may exercise thereon and a storage position in which the treadbase is folded or reoriented to reduce the footprint of the treadmill.

Many folding exercise devices also include a mechanism that holds the folding portion of the exercise device, such as a treadbase, in the storage position. For instance, some treadmills include a pin connected to an upright frame. When the treadbase is folded into the storage position, the pin may be positioned within an aperture formed in the treadbase to thereby hold the treadbase in the storage position. To move the treadbase from the storage position to the operating position, the pin may be withdrawn from the aperture. However, the gravitational pull on the treadbase often results in significant friction between the pin and a portion of the aperture, making it difficult to remove the pin from the aperture. To free the pin, users often push on the treadbase to counter the gravitational force and thereby reduce the friction between the pin and the aperture. Counterproductively, however, the users often push too hard on the treadbase, which results in significant friction being created between the pin and another portion of the aperture, again making it difficult to remove the pin from the aperture.

Examples of various folding exercise devices are described in U.S. Pat. No. 931,394, U.S. Pat. No. 5,662,557, U.S. Pat. No. 5,672,140, U.S. Pat. No. 5,674,156, U.S. Pat. No. 5,674,453, U.S. Pat. No. 5,772,560, U.S. Pat. No. 6,974,404, U.S. Pat. No. 7,540,828, U.S. Pat. No. 7,736,279, U.S. Pat. No. 7,740,563, U.S. Pat. No. 7,766,797, U.S. Pat. No. 7,775,940, and U.S. Pat. No. 7,909,740.

SUMMARY OF THE INVENTION

In one aspect of the disclosure, exercise device includes a first frame, a second frame, and a latching mechanism.

In another aspect that may be combined with any of the aspects herein, the second frame is pivotally connected to the first frame.

In another aspect that may be combined with any of the aspects herein, the second frame is movable relative to the first frame between a storage position and an operating position.

In another aspect that may be combined with any of the aspects herein, the latching mechanism selectively holds the second frame in the storage position.

In another aspect that may be combined with any of the aspects herein, the latching mechanism includes a seat associated with the first frame.

In another aspect that may be combined with any of the aspects herein, the seat has a seat engagement surface.

In another aspect that may be combined with any of the aspects herein, the latching mechanism includes a seat engagement member associated with the second frame.

In another aspect that may be combined with any of the aspects herein, the seat engagement member may be selectively positioned on the seat engagement surface to hold the second frame in the storage position.

In another aspect that may be combined with any of the aspects herein, the latching mechanism includes a lever that selectively rotates the seat engagement member off of the seat to allow the second frame to move from the storage position to the operating position.

In another aspect that may be combined with any of the aspects herein, the seat engagement surface faces in a generally upward direction.

In another aspect that may be combined with any of the aspects herein, the seat engagement member has a first end mounted on a rod and a second end that extends generally radially away from the rod.

In another aspect that may be combined with any of the aspects herein, the second end of the seat engagement member has a wheel mounted thereon.

In another aspect that may be combined with any of the aspects herein, the rod has a longitudinal axis and is rotatably connected to the second frame such that the rod is rotatable about the longitudinal axis.

In another aspect that may be combined with any of the aspects herein, the longitudinal axis of the rod is generally parallel to a longitudinal axis of the second frame.

In another aspect that may be combined with any of the aspects herein, the second frame moves between the storage position and the operating position about an axis that is generally perpendicular to the longitudinal axis of the rod.

In another aspect that may be combined with any of the aspects herein, the lever is connected to the rod.

In another aspect that may be combined with any of the aspects herein, the lever and the seat engagement member are disposed adjacent opposing ends of the rod.

In another aspect that may be combined with any of the aspects herein, the rod extends along a substantial length of the second frame.

In another aspect that may be combined with any of the aspects herein, the seat engagement member is movable between a first angular position and a second angular position.

In another aspect that may be combined with any of the aspects herein, the seat engagement member is positioned on the seat engagement surface in the first angular position and is off of the seat engagement surface in the second angular position.

In another aspect that may be combined with any of the aspects herein, the seat engagement member is biased toward the first angular position.

In another aspect that may be combined with any of the aspects herein, the seat has a seat guide surface that maintains the seat engagement member in the second angular position when the second frame is moved toward the operating position.

In another aspect that may be combined with any of the aspects herein, the exercise device also includes a gas spring connected between the first frame and the second frame to urge the second frame toward the storage position.

In another aspect that may be combined with any of the aspects herein, the exercise device comprises a treadmill and the second frame comprises a treadbase upon which a user may ambulate when the treadbase is in the operating position.

In another aspect that may be combined with any of the aspects herein, a treadmill includes a frame, a treadbase, and a latching mechanism.

In another aspect that may be combined with any of the aspects herein, the frame has a base frame that rests on a support surface and a generally upright frame that extends generally upwardly from the base frame.

In another aspect that may be combined with any of the aspects herein, the treadbase has a first end and a second end.

In another aspect that may be combined with any of the aspects herein, the treadbase is pivotally connected to the frame.

In another aspect that may be combined with any of the aspects herein, the treadbase is movable between an operating position in which the first end of the treadbase is positioned toward the support surface and a storage position in which the first end of the treadbase is positioned toward the upright structure of the frame.

In another aspect that may be combined with any of the aspects herein, the latching mechanism selectively holds the treadbase in the storage position.

In another aspect that may be combined with any of the aspects herein, the latching mechanism includes seat secured to the frame.

In another aspect that may be combined with any of the aspects herein, the seat has a seat engagement surface.

In another aspect that may be combined with any of the aspects herein, the latching mechanism includes a rod having a longitudinal axis.

In another aspect that may be combined with any of the aspects herein, the rod is rotatably connected to the treadbase such that the rod can rotate about its longitudinal axis.

In another aspect that may be combined with any of the aspects herein, the latching mechanism includes a seat engagement member connected to the rod.

In another aspect that may be combined with any of the aspects herein, the seat engagement member moves between a first position and a second position as the rod is rotated about its longitudinal axis.

In another aspect that may be combined with any of the aspects herein, the seat engagement member engages the seat engagement surface on the seat when the seat engagement member is in the first position, thereby selectively maintaining the treadbase in the storage position.

In another aspect that may be combined with any of the aspects herein, the engagement member does not engage the seat engagement surface on the seat when the seat engagement member is in the second position, thereby allowing the treadbase to move to the operating position.

In another aspect that may be combined with any of the aspects herein, the latching mechanism includes a lever connected to the rod.

In another aspect that may be combined with any of the aspects herein, the lever is movable in first and second opposing directions.

In another aspect that may be combined with any of the aspects herein, movement of the lever in the second direction causes the seat engagement member to move to the second position and out of engagement with the seat engagement surface.

In another aspect that may be combined with any of the aspects herein, the seat engagement member has a first end mounted on the rod and a second end that extends generally radially away from the rod.

In another aspect that may be combined with any of the aspects herein, the second end of the seat engagement member has a wheel mounted thereon.

In another aspect that may be combined with any of the aspects herein, the treadbase has a longitudinal axis that is generally parallel to the longitudinal axis of the rod.

In another aspect that may be combined with any of the aspects herein, the lever is connected to the rod adjacent the first end of the treadbase and the seat engagement member is connected to the rod adjacent the second end of the treadbase.

In another aspect that may be combined with any of the aspects herein, the seat comprises a seat guide surface that guides the movement of the seat engagement member as the treadbase is moved from the storage position to the operating position and which maintains the seat engagement member in the second position when the treadbase is not in the storage position.

DETAILED DESCRIPTION

Figure 1:
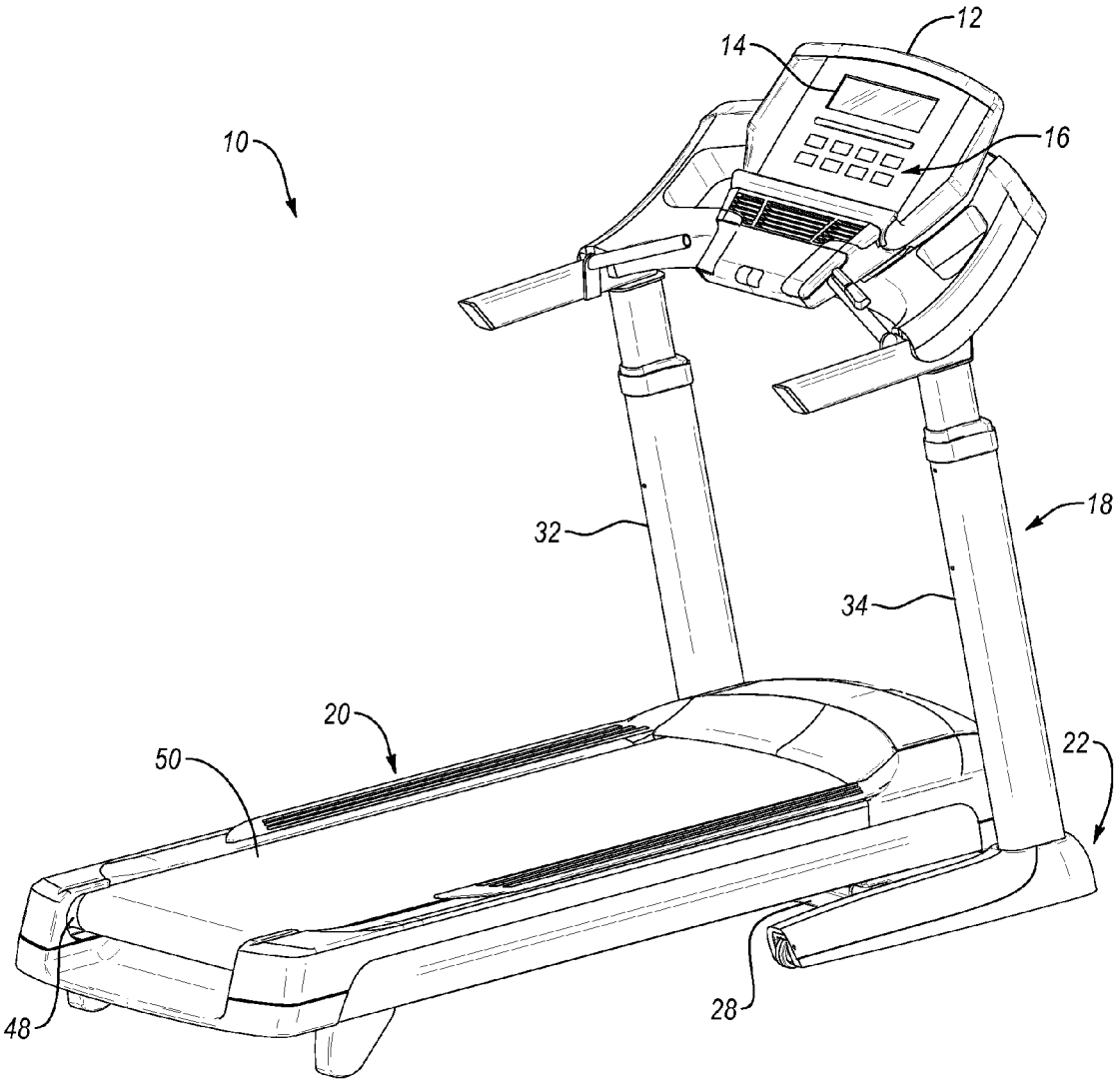
FIG. 1 illustrates a perspective view of an exercise device according to one embodiment of the present invention.
Figure 2:
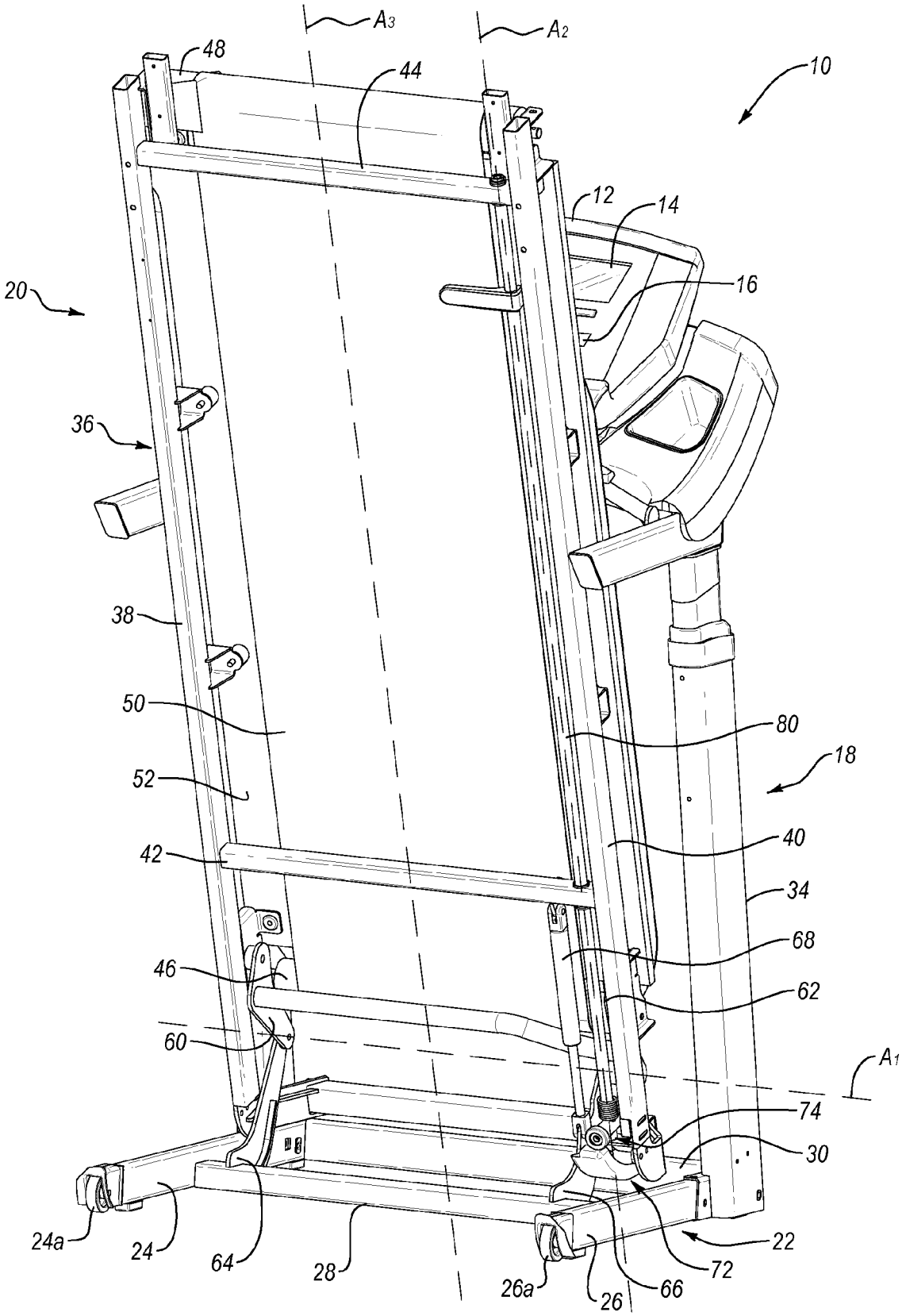
FIG. 2 illustrates another perspective view of the exercise device of FIG. 1 showing a treadbase in a storage position and a latching mechanism that maintains the treadbase in the storage position.

Depicted in FIGS. 1 and 2 is a representation of one illustrative exercise device 10. Exercise device 10, which is illustrated as a treadmill, in one embodiment, includes a console or control panel 12 having a display 14 and various inputs 16. Control panel 12 is supported on a support structure or frame 18. Support frame 18 is one example of a first frame or a generally stationary frame. A treadbase 20 is pivotally connected to support frame 18 to enable treadbase 20 to move between an operating or first position as shown in FIG. 1 and a storage or second position as shown in FIG. 2. Treadbase 20 is one example of a second frame or a pivoting frame.

Support frame 18 includes a base frame 22. In FIG. 2, cosmetic covers are removed from base frame 22 to show that base frame 22 includes left and right feet 24, 26, respectively, that rest upon a support surface. Additionally, base frame 22 also include cross supports 28, 30 connected between feet 24, 26. Left and right feet 24, 26 have respective left and right wheels 24*a*, 26*a* attached thereto. When treadbase 20 is in the storage position, exercise device 10 may be tipped or rotated onto wheels 24*a*, 26*a* and rolled to a new location. Support frame 18 also includes left and right generally upright members 32, 34, respectively. Lower ends of upright members 32, 34 are connected to base frame 22 while upper ends of upright members 32, 34 support control panel 12.

As seen in FIG. 2, the illustrated embodiment of treadbase 20 includes a frame 36 having left and right side rails 38, 40 and first and second cross bars 42, 44 connected between side rails 38, 40. Treadbase 20 also includes front and rear pulleys 46, 48 connected to side rails 38, 40. A continuous belt 50 extends between and around front and rear pulleys 46, 48. Front and rear pulleys 46, 48 and continuous belt 50 may each be considered a movable element that is movable during the performance of an exercise. A deck 52, commonly fabricated from wood, is connected to treadbase frame 36 and supports the upper run of belt 50 and an exercising individual positioned upon belt 50.

Although not shown, as is common with electric treadmills, at least one of front and rear pulleys 46, 48 may be mechanically connected to an electric drive motor 54 by way of a drive belt 56. Optional drive motor 54 may be electrically connected to a controller 58 that controls the operation of drive motor 54, and thus the speed of belt 50, in response to various user inputs or other control signals.

When treadbase 20 is in the operating or first position shown in FIG. 1, a user may ambulate on belt 50. In contrast, when exercise device 10 is not in use, treadbase 20 may be moved to the storage or second position shown in FIG. 2 to reduce the amount of space occupied by exercise device 10. To enable the movement of treadbase 20 between the operating and storage positions, treadbase 20 is pivotally connected to support frame 18.

The pivotal connection between treadbase 20 and support frame 18 is shown in FIG. 2. In the illustrated embodiment, left and right pivot brackets 60, 62 are connected or linked to frame 36. More specifically, each of left and right pivot brackets 60, 62 includes a first end and a second end, the first ends of left and right pivot brackets 60, 62 being connected or linked respectively to left and right side rails 38, 40. In addition to pivot brackets 60, 62, exercise device 10 also includes left and right base brackets 64, 66, each of which has a first end connected to base frame 22 and a second end that extends upwardly from base frame 22. The second end of left pivot bracket 60 is pivotally connected to the second end of left base bracket 64 and the second end of right pivot bracket 62 is pivotally connected to the second end of right base bracket 66, such as with one or more bolts, pins, or rods. The one or more bolts, pins, or rods that pivotally connect pivot brackets 60, 62 to base brackets 64, 66 may function as axles to enable treadbase 20 to pivot about axis $A_1$ between the operating and storage positions. It is understood that the illustrated pivotal connection between treadbase 20 and support frame 18 is only one example of a pivoting connection that may be used in connection with exercise device 10.

Exercise device 10 may also include a gas spring 68 that facilitates the movement of treadbase 20 between the operating and storage positions. In the illustrated embodiment, gas spring 68 is connected between treadbase 20 and base frame 22. More specifically, gas spring 68 is connected between first cross bar 42 of treadbase frame 32 and right base bracket 66, but gas spring 68 may alternatively be connected between other portions of treadbase 20 and base frame 22.

Gas spring 68 is connected between treadbase 20 and base frame 22 to provide a force or torque urging treadbase 20 from the operating position toward the storage position. As a result, gas spring 68 assists with moving treadbase 20 from the operational position to the storage position by reducing the force required of a user to lift treadbase 20 to the storage position. Conversely, the force or torque provided by gas spring 68 also provides for a controlled descent of treadbase 20 from the storage position to the operating position. More specifically, the force or torque from gas spring 68 may resist, but not completely stop, the movement of treadbase 20 from the storage position toward the operating position. As a result, treadbase 20 may move from the storage position to the operating position in a controlled and safe manner.

Figure 3:
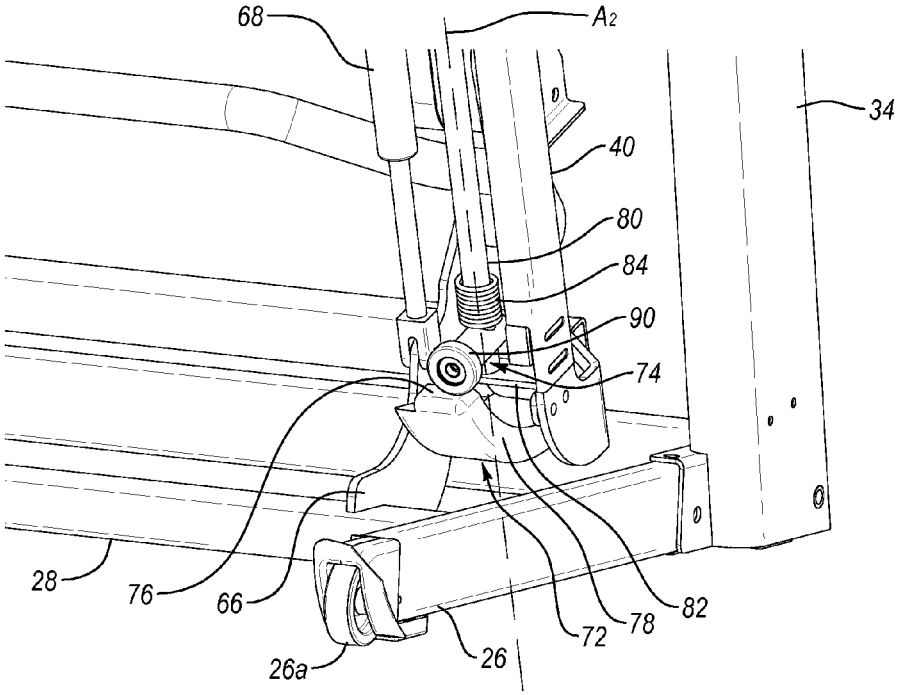
FIG. 3 illustrates a seat and a seat engagement member of the latching mechanism of FIG. 3 with the seat engagement member engaged with the seat to maintain the treadbase in the storage position.
Figure 4:
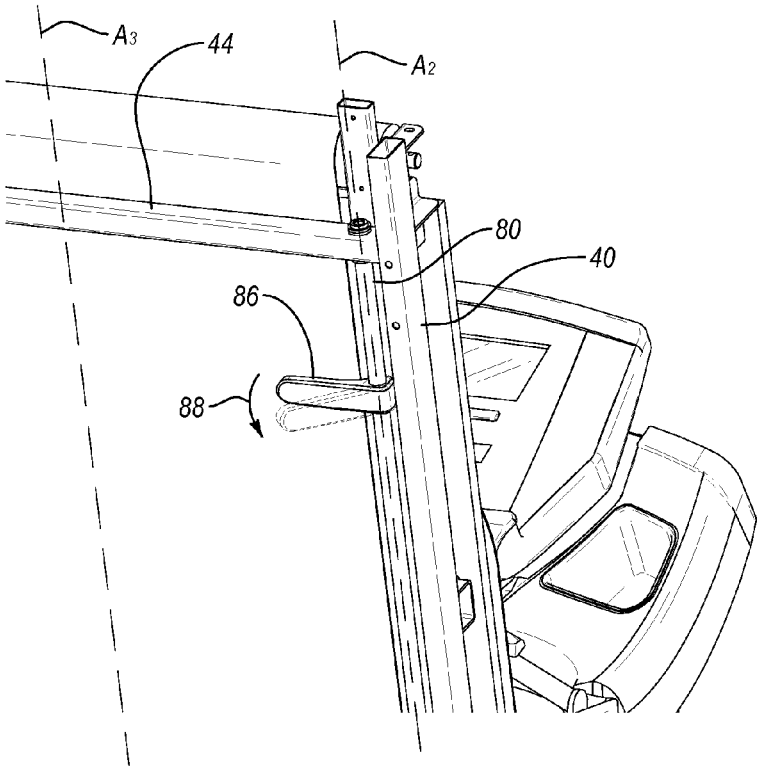
FIG. 4 illustrates the operation of a latching mechanism lever of the latching mechanism of FIG. 3.
Figure 5:
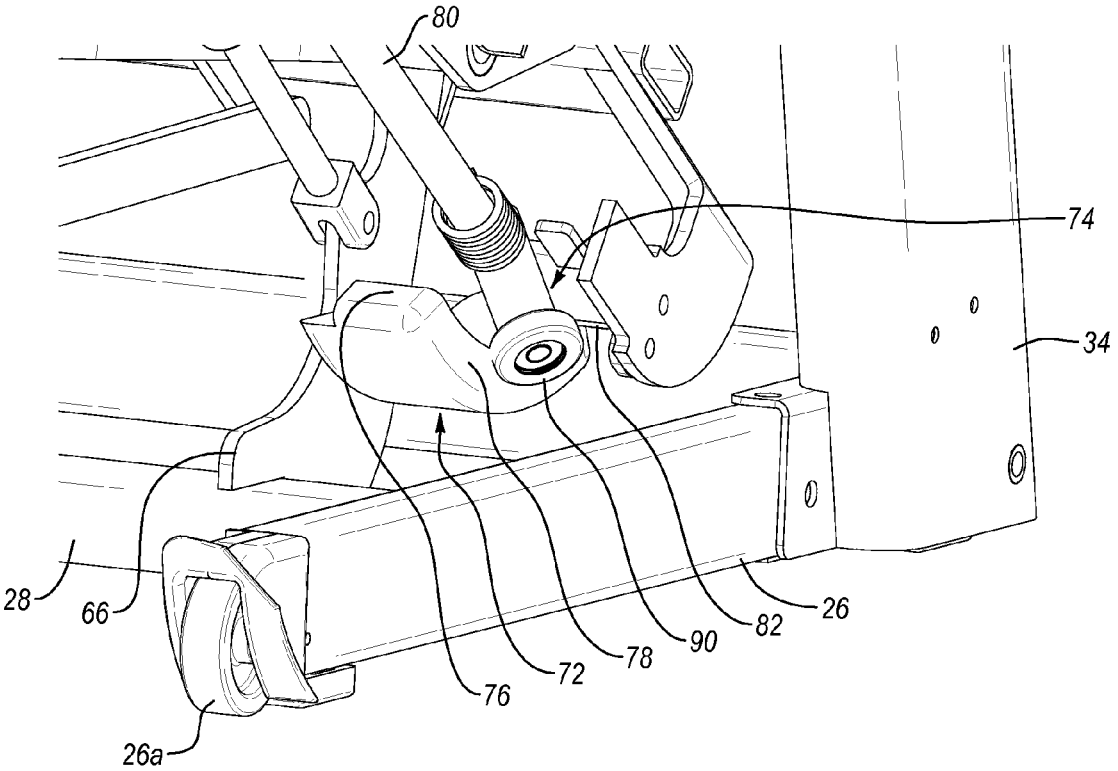
FIG. 5 illustrates the seat engagement member disengaged from the seat to enable the treadbase to move from the storage position toward the operating position.
Figure 6:
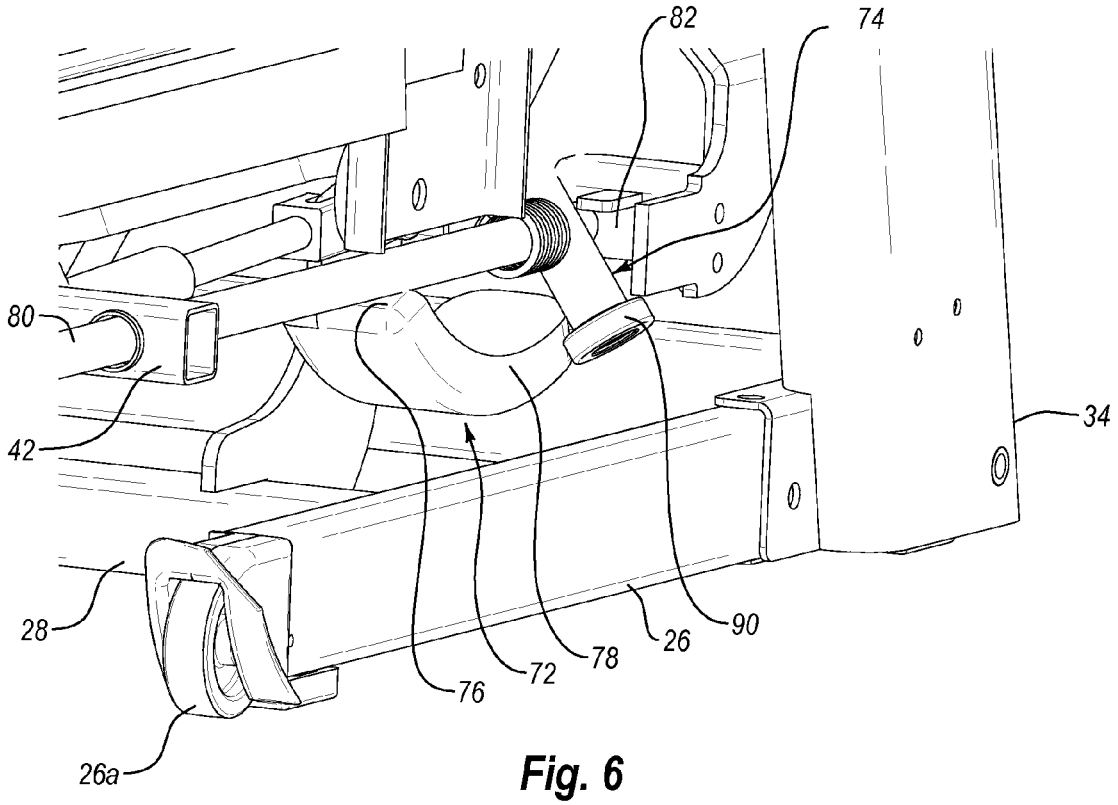
FIG. 6 illustrates the seat engagement member disengaged from the seat and the treadbase in the operating position.

With continued attention to FIG. 2, attention will also now be directed to FIGS. 3-6 in connection with the description of a latching mechanism 70. Latching mechanism 70 includes a seat 72 and a seat engagement member 74 that cooperate to selectively maintain treadbase 20 in the storage position, as shown in FIGS. 2 and 3, as well as allow treadbase 20 to be selectively moved from the storage position to the operating position, as shown in FIGS. 5 and 6.

According to the illustrated embodiment, seat 72 is associated with support frame 18 and seat engagement member 74 is associated with treadbase 20. Regarding seat 72, in the illustrated embodiment, seat 72 is connected to right base bracket 66 in a generally stationary position. Seat 72 may alternatively be connected to left base bracket 64, base frame 22, left upright member 32, or right upright member 34. Seat 72 includes a seat engagement surface 76 that may be selectively engaged by seat engagement member 74 to maintain treadbase 20 in the storage position. For instance, seat engagement surface 76 may face in a generally upward direction and a portion of seat engagement member 74 may rest thereon to maintain treadbase 20 in the storage position. Seat 72 also includes a seat guide surface 78, which will be discussed below.

Regarding seat engagement member 74, according to the illustrated embodiment, seat engagement member 74 has a first end that is mounted on a rod 80 and a second end that extends generally radially away from rod 80 and engages seat engagement surface 76. Rod 80 is connected to treadbase 20 such that rod 80 and seat engagement member 74 move with treadbase 20 when treadbase 20 moves between the operating and storage positions. Specifically, rod 80 is connected to treadbase frame 36. Even more specifically, as can be seen in FIGS. 2-6 of the example embodiment, a first end of rod 80 is connected to a bracket 82 that is connected to right side rail 40 while a second end of rod 80 is connected to second cross bar 44 of frame 36. As a result, rod 80 extends along a substantial portion of the length of treadbase 20. As can also be seen in FIGS. 2 and 6, rod 80 extends through first cross bar 42.

It is understood that rod 80 may be connected to treadbase 20 is a variety of ways and at a variety of locations, and the illustrated manner and location are not intended to limit the present invention. Rather, rod 80 may be connected to treadbase 20 in any manner and at any location that allows rod 80, and thus seat engagement member 74, to rotate about an axis $A_2$ and enables seat engagement member 74 to selectively engage seat engagement surface 76.

According to the illustrated embodiment, axis $A_2$ is generally coaxial with a longitudinal axis of rod 80. Additionally, axis $A_2$ is generally parallel with a longitudinal axis $A_3$ of treadbase 20. Accordingly, rotation of rod 80 and seat engagement member 74 about axis $A_2$ constitutes rotation about an axis that is generally parallel to a longitudinal axis of treadbase 20. As can be seen in FIG. 2, axis $A_2$ is also generally perpendicular to axis $A_1$ about which treadbase 20 pivots to move between the operating and storage positions. As a result, the pivoting movement of treadbase 20 between the operating and storage positions about axis $A_1$ results in rod 80 and seat engagement member 74 also pivoting about axis $A_1$.

The ability of rod 80, and correspondingly seat engagement member 74, to rotate about axis $A_2$ enables seat engagement member 74 to be selectively rotated about axis $A_2$ between at least a first angular position and a second angular position. In the first angular position, seat engagement member 74 is aligned with and/or positioned on/above seat engagement surface 76, as shown in FIGS. 2 and 3. For instance, when treadbase 20 is moved to the storage position as shown in FIG. 2, rod 80 may be rotated in a first direction (which is opposite to the direction indicated by arrow 88 in FIG. 4) about axis $A_2$ to the first angular position to align and/or position seat engagement member 74 on/above seat engagement surface 76, as shown in FIGS. 2 and 3. The rotation of rod 80, and thus seat engagement member 74, in the first direction may be the result of a manual rotation of rod 80. For instance, once treadbase 20 is in the storage position, a user may rotate rod 80 in the first direction to position seat engagement member 74 on seat engagement surface 76. Alternatively, rod 80 may be biased to rotate in the first direction such that rod 80 and seat engagement member 74 automatically rotate in the first direction and to the first angular position when treadbase 20 is moved to the storage position.

Rod 80 may be biased in the first direction in a variety of ways. For instance, as shown in the Figures, rod 80 may have a spring 84 disposed thereon that urges rod 80 in the first direction and toward the first angular position. In the illustrated embodiment, spring 84 has a first end connected to rod 80 and a second end connected to right side rail 40, which allows spring 84 to create the biasing force to urge rod 80 toward the first angular position. Rod 80 may be biased toward the first angular position using other biasing mechanisms, including leaf springs, elastic members (e.g., elastic bands, foams, rubbers), and the like.

When treadbase 20 is to be moved from the storage position to the operating position, rod 80, and correspondingly seat engagement member 74, may be rotated in a second direction (indicated by arrow 88 in FIG. 4) about axis $A_2$ to the second angular position. In the second angular position, seat engagement member 74 is offset from and/or removed/disengaged from seat engagement surface 76, as shown in FIGS. 5 and 6. In order to move rod 80 and seat engagement member 74 to the second angular position, and thereby remove seat engagement member 74 from seat engagement surface 76, a user may manually rotate rod 80 in the second direction.

To facilitate the rotation of rod 80 in the second direction, a handle or lever 86 may be connected to rod 80, as shown in FIG. 4. Accordingly, a user may move handle 86 in the direction of arrow 88. As handle 86 moves in the direction of arrow 88, rod 80 likewise rotates about axis $A_2$ in the direction of arrow 88. As noted, rotation of rod 80 in the second direction causes seat engagement member 74 to also rotate in the second direction, thereby disengaging or removing seat engagement member 74 from seat engagement surface 76, as shown in FIGS. 5 and 6.

When seat engagement member 74 is removed or disengaged from seat engagement surface 76 (e.g., moved to the second angular position), treadbase 20 may be rotated about axis $A_1$ toward the operating position, as shown in FIGS. 5 and 6. As treadbase 20 moves toward the operating position, seat engagement member 74 may pass over seat guide surface 78 as also shown in FIGS. 5 and 6. For instance, seat engagement member 74 may slide or roll along seat guide surface 78 as treadbase 20 moves toward the operating position. As treadbase 20 moves toward the operating position, seat guide surface 78 prevents seat engagement member 74 from rotating in the first direction. Nevertheless, when treadbase 20 is moved back to the storage position, seat engagement member 74 passes above seat guide surface 78 to allow seat engagement member 74 to rotate to the first angular position discussed above.

In order to facilitate the movement of seat engagement member 74 on and off of seat engagement surface 76 and over seat guide surface 78, seat engagement member 74 may include a friction reducing feature. For instance, according the present embodiment, a wheel 90 is mounted on the second end of seat engagement member 74. Wheel 90 may roll over seat engagement surface 76 and seat guide surface 78, thereby reducing the friction associated with moving seat engagement member 74 on and off of seat engagement surface 76 and over seat guide surface 78. Alternatively, seat engagement member 74 and/or seat 72 may be formed or coated with a low friction material.

INDUSTRIAL APPLICABILITY

In general, embodiments of the present disclosure relate to exercise devices that may be folded to reduce the footprint of the exercise device when not in use. The exercise devices may be any type of folding exercise device, such as a treadmill, a Nordic style ski exercise device, a stepper, a hiker, a climber, or an elliptical. More specifically, the invention relates to or may be employed with any type of exercise device that includes a first or stationary portion, such as a support frame, and a second portion (e.g., treadbase, foot linkages/supports, flywheel/crank assembly) that may be folded or reoriented relative to the first portion. Such second portions may be considered second or pivoting frames.

Regardless of the specific type of folding exercise device, the second portions may be folded or reoriented relative to the first portions between operating positions and storage positions. When the second portions are in the operating positions, a user may exercise thereon. When the exercise devices are not in use, the second portions may be moved to the storage positions to reduce the amount of space taken up by the exercise devices.

In addition to being able to fold up to reduce space consumption, exercise devices of the present invention also include a latching mechanism that selectively and securely maintains the second portions in the storage positions. For instance, the latching mechanism may include a seat and a seat engagement member that cooperate to selectively maintain the second portion of the exercise device in the storage position and which may be disengaged to allow the second portion to move to the operating position. More specifically, the seat engagement member may be pivotally connected to the second portion so that is can pivot back and forth between first and second positions. The seat engagement member may be moved to the first position in order to engage a seat engagement surface on the seat, and thereby secure the second portion in the storage position. The seat engagement member may also be moved to the second position in order to disengage the seat engagement surface, and thereby allow the second portion to move to the operating position.

The seat engagement member may be pivotally connected to the second portion of the exercise device in a number of ways. For instance, the seat engagement member may be mounted on a rod that is pivotally connected to the second portion of the exercise device. The rod may be connected to the second portion in any suitable manner that allows the rod to rotate about its longitudinal axis. When the second portion of the exercise device is in the storage position, the rod may be rotated about its axis to pivot the seat engagement member into or out of engagement with the seat engagement surface.

To engage the seat engagement surface, the seat engagement member is moved so as to rest on top of the seat engagement surface, which prevents the second portion of the exercise device from moving toward the operating position. In order to move the seat engagement member into engagement with the seat engagement surface, the rod upon which the seat engagement member is mounted is rotated in a first direction. The rod may be manually rotated by a user, or a biasing mechanism, such as a spring, may automatically rotate the rod.

In order to move the second portion of the exercise device to the operating position, the seat engagement member is pivoted or otherwise moved off of the seat engagement surface. This can be done by rotating the rod upon which the seat engagement member is mounted in a second direction. The second direction can be generally opposite to the first direction. To facilitate the rotation of the rod in the second direction, a rod or lever may be connected to the rod so that a user may rotate the rod by moving the lever. In some embodiments, the lever is connected to the rod adjacent one end of the rod while the seat engagement member is mounted on the rod adjacent an opposing end of the rod. Accordingly, the seat engagement member and the lever may be spaced apart such that the seat engagement member and the lever are disposed adjacent opposing ends of the second portion of the exercise device.

According to some embodiments, only one side of the seat engagement member engages the seat. Significantly, the side of the seat engagement member opposite to the seat does not engage any surfaces. As a result, the friction that resists the movement of the seat engagement member (e.g., the friction between the seat engagement member and the seat) can be reduced by lifting the seat engagement member slightly off of the seat. Thus, when a user desires to move the second portion to the operating position, the user push on second portion to slightly lift the seat engagement member off of the seat, which will allow the user to readily rotate the seat engagement member away from the seat engagement surface. Notably, since the opposite side of the seat engagement member does not engage any surfaces, lifting the seat engagement member off of the seat will not result in additional frictional forces that oppose the movement of the seat engagement member away from the seat.

What is claimed is:

1. A treadmill, comprising:

a first frame;

a second frame including a treadbase, the second frame being pivotally connected to the first frame, the second frame being movable relative to the first frame between a storage position and an operating position; and a latching mechanism that selectively holds the second frame in the storage position, the latching mechanism comprising:

a seat associated with the first frame, the seat having a seat engagement surface;

a seat engagement member associated with the second frame and which may be selectively positioned on the seat engagement surface to hold the second frame in the storage position; and a lever that selectively rotates the seat engagement member off of the seat to allow the second frame to move from the storage position to the operating position;

wherein the seat engagement member is movable between a first angular position and a second angular position, wherein the seat engagement member is positioned on the seat engagement surface in the first angular position and is off of the seat engagement surface in the second angular position;

wherein the seat has a seat guide surface that maintains the seat engagement member in the second angular position when the second frame is moved toward the operating position.

2. The treadmill of claim 1, wherein the seat engagement surface faces in a generally upward direction.

3. The treadmill of claim 1, wherein the seat engagement member has a first end mounted on a rod and a second end that extends generally radially away from the rod.

4. The treadmill of claim 3, wherein the second end of the seat engagement member has a wheel mounted thereon.

5. The treadmill of claim 3, wherein the rod has a longitudinal axis and is rotatably connected to the second frame such that the rod is rotatable about the longitudinal axis.

6. The treadmill of claim 5, wherein the longitudinal axis of the rod is generally parallel to a longitudinal axis of the second frame.

7. The treadmill of claim 5, wherein the second frame moves between the storage position and the operating position about an axis that is generally perpendicular to the longitudinal axis of the rod.

8. The treadmill of claim 3, wherein the lever is connected to the rod.

9. The treadmill of claim 8, wherein the lever and the seat engagement member are disposed adjacent opposing ends of the rod.

10. The treadmill of claim 3, wherein the rod extends along a substantial length of the second frame.

11. The treadmill of claim 1, wherein the seat engagement member is biased toward the first angular position.

12. The treadmill of claim 1, further comprising a gas spring connected between the first frame and the second frame to urge the second frame toward the storage position.

13. The treadmill of claim 1, wherein the treadbase of the second frame comprises a surface upon which a user may ambulate when the treadbase is in the operating position.

14. A treadmill comprising:

a frame having a base frame that rests on a support surface and a generally upright structure that extends generally upwardly from the base frame;

a treadbase having a first end and a second end, the treadbase being pivotally connected to the frame and movable between an operating position in which the first end of the treadbase is positioned proximally the support surface and a storage position in which the first end of the treadbase is positioned proximally the upright structure of the frame; and a latching mechanism that selectively holds the treadbase in the storage position, the latching mechanism comprising:

a seat secured to the frame, the seat having a seat engagement surface;

a rod having a longitudinal axis, the rod being rotatably connected to the treadbase such that the rod can rotate about its longitudinal axis;

a seat engagement member connected to the rod, wherein the seat engagement member moves between a first position and a second position as the rod is rotated about its longitudinal axis, wherein the seat engagement member engages the seat engagement surface on the seat when the seat engagement member is in the first position, thereby selectively maintaining the treadbase in the storage position, and wherein the engagement member does not engage the seat engagement surface on the seat when the seat engagement member is in the second position, thereby allowing the treadbase to move to the operating position; and a lever connected to the rod, wherein the lever is movable in first and second opposing directions, wherein movement of the lever in the second direction causes the seat engagement member to move to the second position and out of engagement with the seat engagement surface;

wherein the seat engagement member has a first end mounted on the rod and a second end that extends generally radially away from the rod, wherein the second end of the seat engagement member has a wheel mounted thereon.

15. The treadmill of claim 14, wherein the treadbase has a longitudinal axis that is generally parallel to the longitudinal axis of the rod.

16. The treadmill of claim 14, wherein the lever is connected to the rod adjacent the first end of the treadbase and the seat engagement member is connected to the rod adjacent the second end of the treadbase.

17. The treadmill of claim 14, wherein the seat comprises a seat guide surface that guides the movement of the seat engagement member as the treadbase is moved from the storage position to the operating position and which maintains the seat engagement member in the second position when the treadbase is not in the storage position.

* * * * *